United States Patent [19]

Holden

[11] 3,955,429

[45] May 11, 1976

[54] INERTIA MOTOR VEHICLE

[76] Inventor: John E. Holden, R.D. No. 1, Box 304, Mount Joy, Pa. 19552

[22] Filed: Feb. 14, 1974

[21] Appl. No.: 442,490

[52] U.S. Cl. ..... 74/64; 74/573 R; 46/209; 280/217

[51] Int. Cl.[2] ..... E16H 33/02

[58] Field of Search ..... 74/64, 573, 5.22; 280/217; 180/1 E; 46/206, 209

[56] References Cited

UNITED STATES PATENTS

| | | | |
|---|---|---|---|
| 1,344,108 | 6/1920 | Willis | 280/217 |
| 2,704,416 | 3/1955 | Laird | 74/573 |
| 3,650,067 | 3/1972 | Greenwood | 46/209 |
| 3,698,129 | 10/1972 | Lemelson | 46/209 |

FOREIGN PATENTS OR APPLICATIONS

| | | | |
|---|---|---|---|
| 38,403 | 11/1913 | Sweden | 280/217 |
| 173,225 | 12/1905 | Germany | 46/209 |
| 874,538 | 8/1961 | United Kingdom | 46/209 |

*Primary Examiner*—Samuel Scott
*Assistant Examiner*—Wesley S. Ratliff, Jr.
*Attorney, Agent, or Firm*—James A. Drobile; Robert S. Bramson

[57] ABSTRACT

An inertia motor for use in toys, comprising a drive gear mounted on one of the axles of the vehicle and having a substantial diameter and rotating a pinion gear which is coaxially mounted with a substantially larger back gear, which in turn drives a pinion which is coaxial with a flywheel, the flywheel being mounted eccentrically with respect to the drive shaft. The flywheel is of such size and weight, and the gear ratios are such that the flywheel is rotated at least about twenty times with each rotation of the drive gear and, therefore, stores a substantial amount of energy which is slowly released from the flywheel to the drive gear to provide a slow, prolonged release of energy to drive the vehicle. In one embodiment of the invention, a pair of gear trains are provided, one on each side of the flywheel, in mirror image to each other, and the housing therefor, which may contain only two wheels, is in a substantially eliptical shape having a flattened bottom. In this latter form, the device may be used alone as an inertia motor-driven toy, capable of gyroscopic action when placed on one of its two wheels and capable of being inserted in a second toy having a suitable enclosure opening, where the second toy is driven, or contains mechanisms driven by, the wheels of the inertia motor insert.

6 Claims, 6 Drawing Figures

Fig. 1
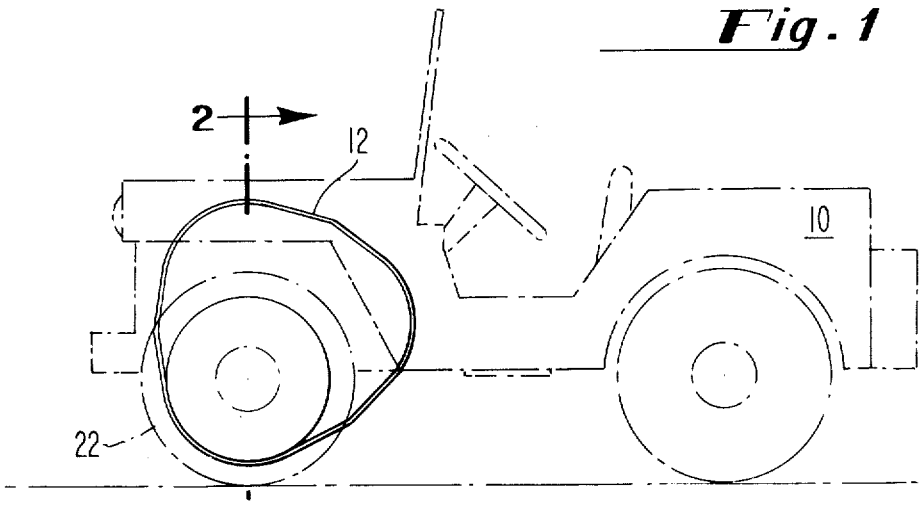
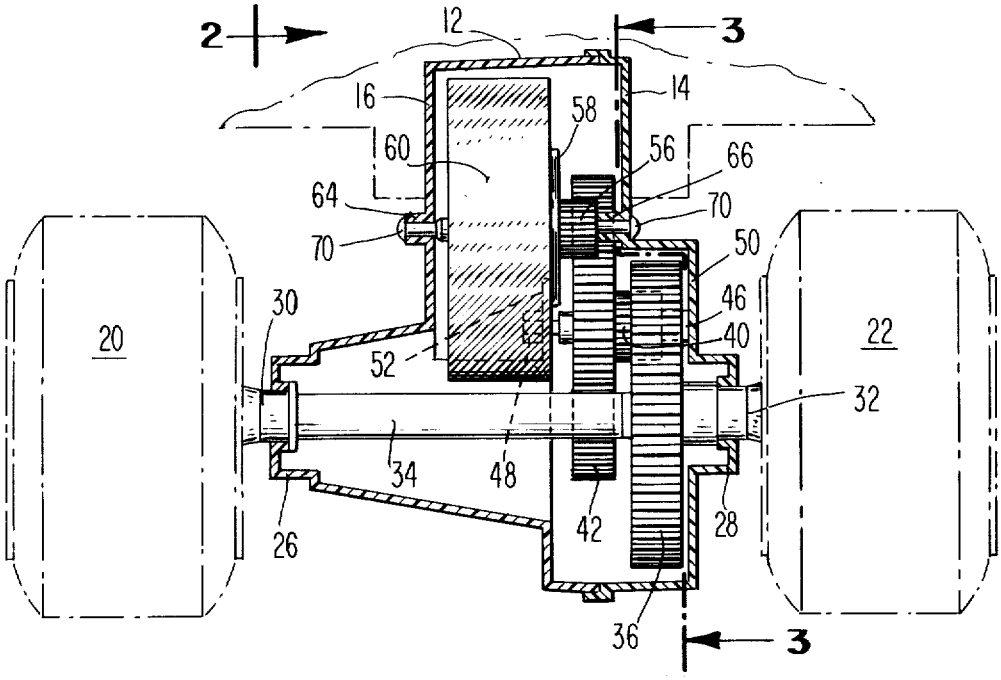
Fig. 2
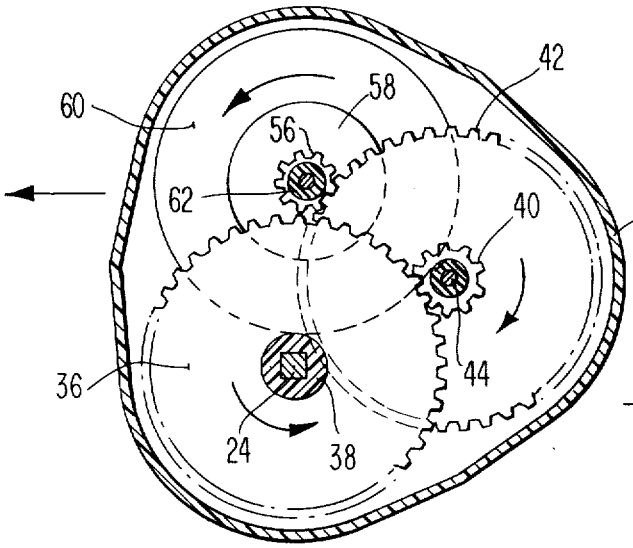
Fig. 3

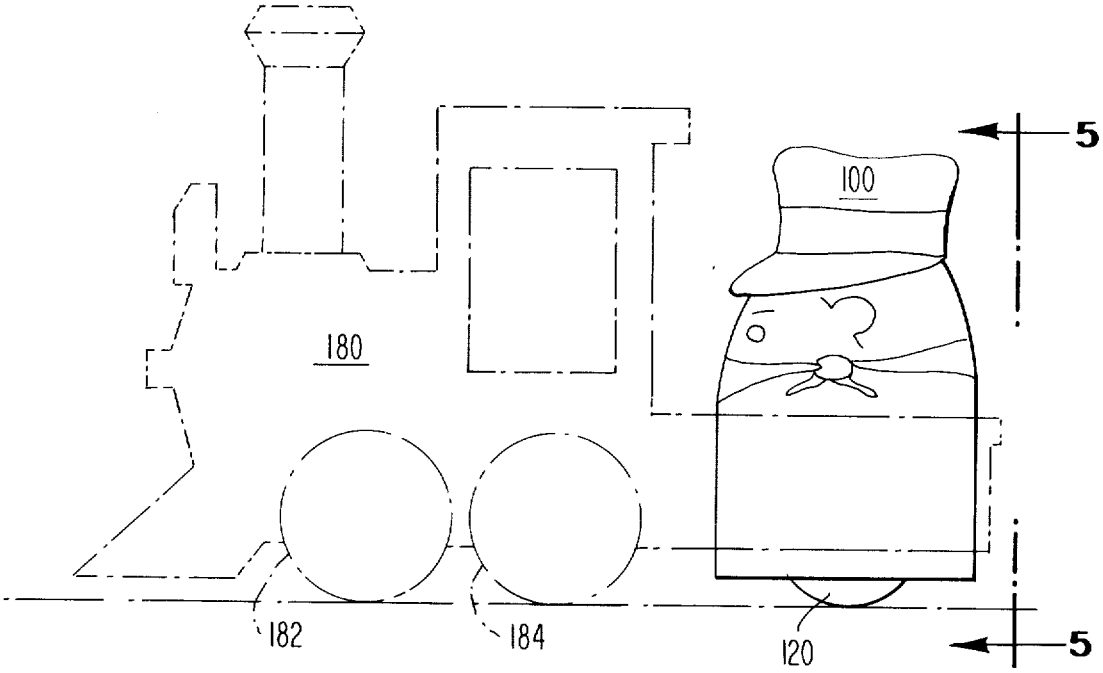
Fig. 4
Fig. 5
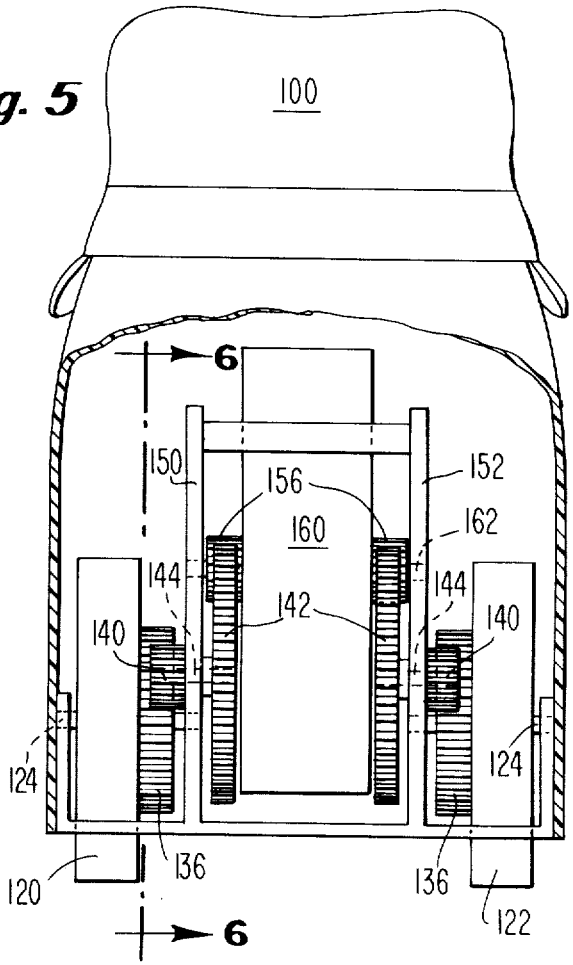
Fig. 6
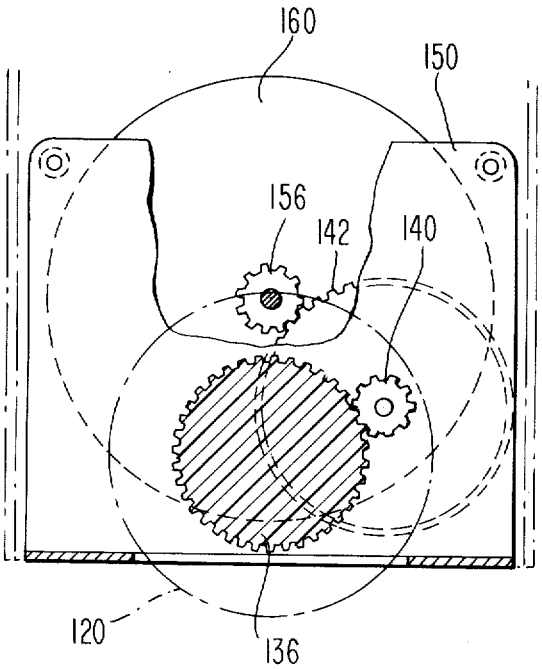

INERTIA MOTOR VEHICLE

BACKGROUND OF THE INVENTION

1. Field of the Invention:

This invention relates to inertia motors and children's toys driven thereby.

2. State of the Art:

Numerous inertia motor devices have been utilized in the prior art for the purpose of driving toys. However, the particular device of the invention provides for an extremely large storage of energy in the inertia wheel and a very slow release of energy from the inertia wheel to the axle of the toy, to provide for a substantial period of release of that energy to drive the toy. In another embodiment of the invention a dual gear train device is provided, having at least two wheels and a housing capable of being used as a friction driven impulse motor toy alone, having gyroscopic action, or capable of being used as an insert for any one of a number of different types of toys.

BRIEF SUMMARY OF THE INVENTION

The invention relates to an inertia motor for use in toys, for propelling a vehicle. In a preferred embodiment to the invention, the inertia motor comprises an axle with wheels mounted on either end, for providing initial traction and energy input to the flywheel. A drive gear is mounted on that axle and drives a pinion, the pinion being rigidly mounted in coaxial relation with a backgear which in turn drives a second pinion which is rigidly mounted and coaxial with the flywheel. The gear ratio between the drive gear and backgear pinion is approximately 6 to 1 and between the backgear and flywheel pinion is approximately 5 to 1, so that a very substantial rotation of the flywheel is achieved with relatively little rotation of the drive axle. Once application of traction is ceased, the flywheel will gradually release energy, through the drive train, to the drive gear and axle, the energy release being extremely small and consequentially extremely prolonged in duration, for up to about two minutes.

In another embodiment of the invention, a single axle, two-wheel unit drives a flywheel having dual gear trains mounted on either side thereof. The unit is capable of functioning independently as a toy, having gyroscopic action if energized and placed on one of the wheels, and is also capable of being used as a motive power source for another toy, when inserted into a suitable aperture.

OBJECTS OF THE INVENTION

It is, therefore, an object of the invention to provide an inertia motor which is capable of storing substantial amounts of energy and releasing the energy very gradually over a prolonged period of time for providing a relatively long-operating toy.

Yet another object of the invention is to provide a novel and economical inertia motor for motor-driven toys.

Still another object of this invention is to provide a two-wheel toy, driven by an inertia motor, which provides a very gradual release of energy over a relatively prolonged period of time, and which is of such design that it may be inserted in another toy having no motive power means, to function as the motive power means thereof.

DESCRIPTION OF THE DRAWINGS

FIG. 1 is a view, in phantom, of a toy jeep, showing the location of the inertia motor housing of the invention;

FIG. 2 is a cross-sectional view, taken along line 2—2 of FIG. 1, and showing the tires and part of the toy body in phantom;

FIG. 3 is a cross-sectional view, taken along line 3—3 of FIG. 2;

FIG. 4 is a side elevational view, partly in phantom, showing yet another embodiment of the invention utilizing a separate, two-wheeled toy, which is inserted in a suitable aperture in another toy, illustrated as a train;

FIG. 5 is a rear elevational view, taken along 5—5 of FIG. 4, with the rear of the toy broken away in part, to show the inertia motor mechanism; and FIG. 6 is a cross-sectional view, taken along line 6—6 of FIG. 5.

DETAILED DESCRIPTION OF THE INVENTION

Viewing FIG. 1, the invention is seen as applied to a toy jeep, generally designated by numeral 10. Although the invention is shown as applied to a jeep, it may be applied to any other type of vehicle, such as, by way of example only and not by way of limitation, a car, fire truck, motorcycle, oil truck, tank, airplane, or the like.

As seen in FIG. 1, fastened to the jeep is a housing, generally designated by numeral 12, which is suitably fastened to the bottom of the jeep, by well known fastening means (not shown). Housing 12 is formed of two halves, the right half being referred by numeral 14, and the left half by numeral 16, and the two halves are fastened together to close the housing, such as by having overlapping ends 18 of housing section 16, adhesively fastened to the underlying surfaces of housing section 14. Alternatively, if it is desired to be able to disassemble the housing, suitable threaded members for engagement by screws may be provided in the housing.

The tires, 20 and 22 may be formed of linear polyethylene, and the flat outer surface of the tire may be encompassed by a rubber band (not shown) for the purpose of providing additional traction to the tires when it is desired to energize the inertia wheel. The tires are rigidly fastened to a rectangular shaft 24, in a manner which is well known in the art, and the shaft is journalled, in suitable journal portions 26 and 28 of housing 12, by means of nylon bearings 30 and 32. Also mounted on the axle 24 is a sleeve 34, for the purpose of holding the drive gear 36 properly located along the axle.

The drive gear 36 has a diameter of about 2.5 inches and has 60 teeth formed thereon. The drive gear 36 is preferably formed of Celcon, a polymer, and is integrally molded with a sleeve 38, which has a square aperture formed therein for the purpose of rotatably engaging the axle 24.

The drive gear 36 rotatably engages the pinion 40 of compound gear 40, 42. Pinion gear 40 and backgear 42 are coaxial, and are formed as a single, integral compound gear, also molded of Celcon material. The compound gear 40, 42 has a circular aperture extending therethrough, and extending through that aperture is a mounting pin 44, which is pointed at either end. The mounting pin 44 is seated in suitable bosses 46 and 48, which are formed in respective opposing faces 50 and 52 of housing segments 14 and 16. The backgear 42 and integral pinion 40 are freely rotatably mounted on the pin 44.

Compound gear 40, 42 has an outer diameter which is identical with that of drive gear 36, and also has 60 gear teeth. The size and shape of the teeth on compound gear 40, 42 is the same as that on drive gear 36. Pinion 40 has an outer diameter of approximately 0.6 inch, and has 12 gear teeth, so that a gear ratio of 5 to 1 is provided between drive gear 36 and pinion gear 40.

Back gear 42 engages the flywheel pinion 56, which is also formed of Celcon plastic and is integrally formed with an enlarged flange 58 thereon which is fastened to the flywheel 60, such as by the use of an adhesive. The flywheel pinion 56 has an outer diameter of approximately 0.5 inch, and has ten teeth, so that a gear ratio of 6 to 1 is achieved between backgear 42 and flywheel pinion 56. Because the flywheel pinion 56 is rigidly mounted to the flywheel, the flywheel 60 rotates as flywheel pinion 56 is rotated. Flywheel shaft 62 extends through an aperture in the flywheel and flywheel pinion, and is seated in respective bosses 64 and 66 in opposing sides of the housing. The flywheel shaft is held in place by suitable rivets 70. The flywheel shaft is rotatably mounted in the bosses, so that the flywheel and its pinion may rotate freely.

The flywheel is formed of metal, preferably iron, and has an outer diameter of approximately 2.6 inches and a width of approximately ⅞ths of an inch. In order to limit the weight of the flywheel, it may desirably be provided with 6 symetrically spaced apertures extending transversely therethrough, having their center lines on a circle having a diameter of approximately 1.5 inches. The purpose of the holes, which must necessarily be uniformly spaced, is to limit the weight of the flywheel, which is desirably, for the dimension shown, approximately 14 ounces.

In operation, the invention functions as follows. The vehicle is held by the operator, and in firmly pressed against the ground, and advanced in a forward direction, so that the front wheels 20 and 22 are rotated in a counter-clockwise direction, viewing FIG. 1. As the wheels rotate, the axle 24, which is rigidly fastened thereto, similarly rotates, and the rotation of the axle is transmitted to drive gear 36, which is lockingly mounted on the axle. The rotation of drive gear 36 is transmitted to pinion 44 which rotates through five revolutions for each revolution of gear 36. Pinion 44 is integrally formed with backgear 42 so that backgear 42 rotates a single revolution with each revolution of the pinion gear 44. Backgear 42 drives flywheel pinion 56, and because of the gear ratio between the backgear and pinion 56, pinion 56 rotates six revolutions for each revolution of backgear 42. Since flywheel 60 is integrally fastened to pinion gear 56, flywheel 60 will rotate a revolution with each revolution of pinion gear 56. Because of the gear ratios between the drive gear 36 and pinion gear 44 and between backgear 42 and pinion gear 56, each revolution of the tires 20 and 22 will cause the flywheel to rotate 30 revolutions. Likewise, after the flywheel has been energized, and the vehicle is released to be driven by the stored energy in the flywheel, the tires 20 and 22 will be driven one-thirtieth of a revolution for each revolution of the flywheel due to its stored energy.

Consequently, the flywheel will store energy at a relatively high rate, compared with the rate of movement of the vehicle 10, and will release energy at an extremely low rate, after the vehicle 10 is released and is propelled only by the stored energy of the flywheel.

Although the specific gear ratios may vary, consistent with the principles of the invention, it is desirable to have a gear ratio of at least 20 to 1 between the rotation of the drive gear 36 and the rotation of the flywheel 60, so that the flywheel 60, rotates at least 20 times for each rotation of the drive gear 36, and so that the drive gear 36 will rotate a twentieth of a revolution with each rotation of the flywheel 60 when the energy of the flywheel impels the vehicle. In order to have an economical, easy to fabricate, and effective device, it is necessary to have a drive gear, backgear, two pinions, and a flywheel. It may be desired to add an additional backgear and pinion, in order further to increase the gear ratio between the drive gear and the flywheel pinion.

It is to be noted that the bearings 30, sleeve 34, tires 20 and 22, and vehicle 10 are formed of linear polyethylene, and that the housing 12 is formed of high impact polystyrene.

Viewing FIG. 5, the embodiment of the invention illustrated therein, which is generally designated by numeral 100, is seen to comprise an inertia motor, similar to that illustrated in FIG. 1 to 3, but having the fly wheel centrally and symetrically mounted therein, with a pair of drive trains, mounted in mirror image configuration to each other one located on either side of the flywheel. The flywheel is generally designated by numeral 160 and is approximately the same shape, material and weight of that illustrated in FIGS. 2 and 3. If desired, all of the gear train elements illustrated in FIGS. 5 and 6 can correspond identically in size, material and numbers of gear teeth to those illustrated in FIGS. 2 and 3. The toy motive power device 100 has mounted therein a pair of stub shafts 124, on which are mounted wheels, respectively designated 120 and 122. Integrally formed or adhesively mounted to respective wheels 120 and 122 are drive gears 136, which respectively drive backgear pinions 140. Backgear pinions 140 are rotatably mounted on stub shafts 144 which extend through flywheel housing members 150 and 152. Mounted on the other end of each stub shaft 144 is a backgear 142, which drivingly engage flywheel pinions 156, each of which is rigidly fastened to flywheel 160. Flywheel pinions 156 are rotatably mounted on stub shafts 162, which are respectively journaled in housing portions 150 and 152. If desired, the wheels 120 and 122 may have mounted thereon two rubberbands for insuring better frictional engagement with a surface for rotating the wheels and transmitting energy from the wheels to the flywheel 160.

In the embodiment of FIG. 5 it is also desirable to have a gear ratio of at least 20 to 1 between the drive gears 136 and the flywheel pinions 156, so that the flywheel 160 will rotate at least twenty times with each rotation of wheels 120 and 122.

In the illustrated example, it will be seen that the shell 100 is attractively formed, with a flat base, below which the wheels 120 and 122 protrude, in the figure of a railroad engineer. The unit 100 may be utilized as a separate toy, which will be self-propelled, by pressing the wheels 120 and 122 against a surface and advancing the unit 100 while so doing. After this is done one or more times, the flywheel has been sufficiently energized, the unit may be placed on a surface, released, and it will move of its own motive power. Because of the very high gear ratio between drive gears 136 and flywheel pinions 156, the energy stored in flywheel 160 will be released to the drive wheels 120 and 122 quite slowly, and the toy will advance slowly over an extremely prolonged period of time compared with prior art devices, of up to about two minutes.

If the flywheel is rotating at a sufficiently high speed, the unit 100 can be made to go in circles by tipping the unit sideways on one wheel. The gyroscopic action of the flywheel unit holds the figure up on one wheel, moving in a circle, for a length of time until the speed of the rotation of the flywheel diminishes to the point where the unit will level and be supported on both wheels, and will then continue to advance in a straight line. The direction of the turn can be changed by tipping the unit to the other side.

In the embodiment shown in FIG. 4, the motive power unit 100 is inserted through a suitable aperture in a form of a steam engine 180, containing two pairs of wheels 182 and 184, but not having any independent motive power means. Thus, the flywheel may be energized, with the unit 100 either separate from, or located in the well in, the train 180, and used to advance the train 180 in a linear direction. Again, because of the high gear ratio between the drive gears 136 and flywheel pinion 156, the train 180 will be advanced very slowly over a relatively prolonged period of time, up to several minutes.

It will be appreciated that, although the invention embodiment of FIG. 4, 5 and 6 is illustrated as an engineer and a railroad train, the principles of the invention can be applied to a wide variety of toys, such as a pilot and an airplane, a policeman and a police car, a racing car driver and a racing car, and so on. Moreover, the unit 100 can act as a removable power source for almost any mechanism, and can be put in contact with a drive belt (not shown) driven by the wheels 120 and 122, which drive belt would be contained by the unit 180, for the purpose of driving other devices associated with the toy, such as to drive an elevator, open a gate, activate a musical instrument, run a dishwasher, or the like.

Moreover, it would be appreciated that the principles of the embodiment illustrated in FIG. 4 can be applied with other type of motive power means than the flywheel device illustrated in FIGS. 5 and 6, such as by using a windup motor, electric motor, or the like.

It will be appreciated that the principles of the invention may be substantially departed from without departing from the spirit and scope of the invention, such as by varying the dimensions, materials, and the specific types of toys to which the invention is applied.

What is claimed is:

1. A toy vehicle of the flywheel propelled type comprising a vehicle body, an axle rotatably mounted in said body, motive power means to rotate said axle consisting of two manually rotatable, friction driven wheels rigidly mounted on said axle and extending beneath said body, a vertically extending drive gear having a vertical axis and mounted on said axle, a pinion gear engaging said drive gear, a vertically extending backgear having an horizontal axis, means rigidly and coaxially rotatably mounting said pinion gear and said backgear, a flywheel pinion gear having an horizontal axis and drivingly engaged by said backgear, a vertically extending flywheel parallel to said drive gear rigidly and coaxially mounted to said flywheel pinion, and means mounted to said vehicle rotatably supporting said flywheel and said flywheel pinion, the gear ratio between said drive gear and said flywheel pinion being at least about twenty to one, two of said vertically extending gears being substantially coplanar, whereby said toy is propelled by rotating said wheels by frictional, moving engagement of said wheels with a surface and whereby release of said vehicle after initial rotation of said wheels allows said vehicle to be driven slowly by the release of energy stored in said flywheel.

2. A toy vehicle as set forth in claim 1 wherein said gear ratio is thirty to one.

3. A toy vehicle as set forth in claim 1, wherein said flywheel is equidistant between said wheels, and wherein two drive trains are mounted on said axle, in mirror image relationship to each other, and on either side of said flywheel.

4. In combination, a first propellable toy unit, having at least one pair of wheels, and defining an opening extending vertically completely through said vehicle to receive a motive power means, and a motive power means mounted in a vertically elongated housing having driven wheels and adapted removably to seat in said opening drivingly to engage said first toy unit.

5. In an apparatus as set forth in claim 4, said motive power means comprising a body, an axle rotatably mounted in said body, two manually rotatable, friction driven wheels rigidly mounted on said axle and extending beneath said body, a vertically extending drive gear having a vertical axis and mounted on said axle, a pinion gear engaging said drive gear, a vertically extending backgear having an horizontal axis, means rigidly and coaxially rotatably mounting said pinion gear and said backgear, a flywheel pinion gear having an horizontal axis and drivingly engaged by said backgear, a vertically extending flywheel parallel to said drive gear rigidly and coaxially mounted to said flywheel pinion, and means mounted to said body rotatably supporting said flywheel and said flywheel pinion, the gear ratio between said drive gear and said flywheel pinion being at least about twenty to one, two of said vertically extending gears being substantially coplanar, whereby said toy is propelled by rotating said wheels by frictional, moving engagement of said wheels with a surface and whereby release of said body and insertion thereof into said opening after initial rotation of said wheels allows said unit to be driven slowly by the release of energy stored in said flywheel.

6. Apparatus as set forth in claim 5, wherein two drive trains are included, each mirror image to the other, and symetrically located with respect to said flywheel.

* * * * *